United States Patent [19]

Ritzka et al.

[11] 4,378,257

[45] Mar. 29, 1983

[54] PROCESS FOR THE TEMPORARY SHUTDOWN OF CONTINUOUS DISCHARGE CARBURIZING PLANTS

[75] Inventors: Karl Ritzka, Waldbronn; Karl Hertweck, Baden-Baden, both of Fed. Rep. of Germany

[73] Assignee: Daimler-Benz Aktiengesellschaft, Stuttgart, Fed. Rep. of Germany

[21] Appl. No.: 262,383

[22] Filed: May 11, 1981

[51] Int. Cl.[3] ..... C21D 1/56

[52] U.S. Cl. ..... 148/16.5; 148/13; 148/20.3

[58] Field of Search ..... 148/16, 16.5, 16.6, 148/16.7, 20.3, 13, 13.1, 14

[56] References Cited

U.S. PATENT DOCUMENTS 4,145,232 3/1979 Solomon ..... 148/16.5

4,306,919 12/1981 Roberge et al. ..... 148/16.5

OTHER PUBLICATIONS

Metals Handbook, 8th ed., vol. 2, p. 97, American Society for Metals, 1964.

*Primary Examiner*—John P. Sheehan

*Attorney, Agent, or Firm*—Craig & Burns

[57] ABSTRACT

A process for the temporary shutdown of continuous-discharge carburizing plants wherein a plurality of metallic components to be hardened are conveyed on a conveyor means in succession through a heating-up zone; a carburizing zone; a pearlitizing zone, if present; and a hardening zone, each zone having an operating gas atmosphere, involves the following steps:

(a) clearing the hardening zone of carburized metallic component products;

(b) stopping the conveyor means, lowering the temperature in the heating-up, carburizing, and hardening zones to 600°-800° C., and replacing the operating gas atmosphere in each zone by an inert gas atmosphere for the temporary period of shutdown;

(c) bringing, after termination of the shutdown period, the heating-up, carburizing, and hardening zones to a predetermined temperature of 850°-880° C., and when a zone has reached the predetermined temperature, replacing the inert gas atmosphere with the operating gas atmosphere; and (d) when all zones have reached the predetermined temperature according to step (c), bringing the hardening zone and the carburizing zone to a rated operating temperature, and thereafter activating the conveyor means, then bringing the heating-up zone to a rated operating temperature.

4 Claims, No Drawings

PROCESS FOR THE TEMPORARY SHUTDOWN OF CONTINUOUS DISCHARGE CARBURIZING PLANTS

In continuous-discharge carburizing plants which are to be shut down over weekends, large losses in capacity arise due to the circumstance that the plants must be operated until empty prior to shutdown. In this connection, the loss of capacity is dependent on the time required by the components to be treated for passing through the installation. The larger the installation, the higher is also the loss of capacity.

In continuous-discharge carburizing plants, the components to be treated, i.e. the product, are conveyed quasi-continuously through the installation, i.e. the furnace, consisting of a heating-up zone, a carburizing zone, optionally a pearlitizing zone, and a hardening zone. The products are disposed in this procedure on plates, pallets, grates, or the like conveyor elements or units which are advanced in cycle fashion by the width of one grate, i.e. the width of one conveyor element. Thus, with each cycle, a grate is introduced into the plant, and a grate, the treatment of which has been completed, leaves the plant. The quasi-continuous, timed transport is performed so that the doors of the installation can be kept closed during the cycle pauses since otherwise no controlled furnace atmosphere can be maintained. The treatment period for the product-filled grates in the individual zones of the installation (i.e. of the furnace) is dependent on the required carburizing depth [case-hardening depth, depth of case] (EHT) wherein the largest portion of the furnace length is taken up by the carburizing zone. The design and construction of continuous-discharge carburizing plants are generally known and described in detail in the literature. In large installations, with, for example, 40 grates, a freshly introduced grate leaves the installation after 40 cycles [timing steps]. Assuming that a time period of between 15 and 20 minutes is provided for one cycle, then, using the mode of operation employed heretofore, the last grate to be treated had to be introduced into the plant as early as 10–13 hours before shutdown and, after startup of the plant, 10–13 hours had to pass as well before the first grate would leave the plant.

Therefore, it is an object of the present invention to reduce these losses in capacity, i.e. to find a process for temporary shutdown wherein the installation can remain stocked with components to be treated, for the largest part, during the shutdown period.

This object has been attained by the process of the present invention wherein the operating parameters e.g. temperature and atmospheric conditions in the plant as well as the loading sequence of the conveyor grates or the like are controlled to reduce the loss in plant capacity. In these carburizing plants, the metallic components to be hardened are successively conveyed through a heating-up zone, possibly a pearlitizing zone and a hardening zone.

Prior to shutdown, the hardening zone is first cleared of product. This is done by introducing, at the appropriate point in the operation sequence, a number of empty grates corresponding to the length of the hardening zone into the plant, so that, considering the cycle period and the furnace length, the hardening zone is stocked with these empty grates at the time of the intended temporary shutdown. In some cases it may also be necessary, depending on the type of plant involved (one-, two-, or three-lane), to leave the last rows of grates, or the two last rows of grates in the heating zone empty downstream of the feed gate, since especially if the temperature cannot be optimally controlled there is the danger in this zone of coarse-grain formation as well as increased oxidation manifestations on the products located on these grates. The process, for purposes of preserving energy, is preferably regulated so that the temperature in the carburizing and heating-up zones is lowered from 910° to 960° C. to 850°–880° C. already at the time the last production plate has been positioned in the hardening zone.

After discharge of the final production grate from the hardening zone, the conveyor mechanism is then turned off, and the temperature in the heating, carburizing, and hardening zones is reduced to 600°–800° C., a temperature of 700° C. being preferred. When lowering the temperature below 600° C., no disadvantages arise, but the heating-up process i.e. during startup is greatly prolonged. Simultaneously with the lowering of the temperature, the operating gas atmosphere is also replaced by an inert gas atmosphere; in this connection it is generally sufficient to replace the operating gas feed consisting of $N_2$ with 18–30% CO and 20–30% $H_2$ by an inert gas feed; the exchanging of operating gas atmosphere for inert gas atmosphere then proceeds at sufficient speed by the burn-off flares of the plant. In general, care should be taken that neither soot formation nor a substantial decarburizing of the products occurs during exchange of the operating gas atmosphere for the inert gas atmosphere. The relationship between operating gas atmosphere, temperature, and carburizing or decarburizing are extremely well known to those skilled in the art (for example, Boudouard equilibrium, iron-carbon diagram) and present no difficulties. While the conveyor mechanism is at a standstill, the furnace doors are locked, thus preventing the furnace atmosphere from becoming impaired by a possible opening of the doors. It is thereby possible to lower the excess pressure in the furnace, amounting in the operating condition to about 15–20 mm $H_2O$ column, to the low value of about 4 mm (2–6 mm) $H_2O$ column. A considerable saving in inert gas is the result. All gases inert with respect to the materials present in the furnace under the given temperature conditions can be utilized as inert gases, for example noble gases such as argon or nitrogen. Nitrogen is the preferred inert gas due to its ready availability.

After termination of shutdown, i.e. at startup, the zones of the plant such as the heating-up zone, the carburizing zone, and the hardening zone, are raised to a temperature of 850°–880° C., preferably 860° C. The heating-up process is controlled so that all three of these zones reach this temperature approximately at the same time; on account of the varying heating efficiency and size of the zones (due to constructional design), the carburizing zone will generally be the last to reach this temperature. This temporal sequence in reaching the temperature is also preferred for reasons of process technology. As soon as the zones have attained the predetermined temperature, the inert gas atmosphere is replaced by the operating gas atmosphere; this is usually effected at adequate speed once the inert gas feed is discontinued and the operating gas feed is initiated. At the same time, the excess pressure required for operation is likewise restored. The temperature of 850°–880° C. is to be maintained rather accurately, since at a temperature of below 850° C. the operating gas feed can lead to soot formation in the furnace, and since above 880° C., in an inert gas atmosphere, an appreciable decarburizing of the products present in the furnace can occur. A temperature of 860° C. is especially preferred, inasmuch as there is no soot formation, but also no decarburizing as yet at this temperature and under the corresponding atmosphere. If the hardening zone has an operating temperature of below 850°–880° C., or if the plant is additionally equipped with a pearlitizing zone, then the plant will, of course, be heated only up to this operating temperature. As soon as all of the zones have reached the temperature of 850°–880° C. or the operating temperature, if the latter temperature is below this value, heating up is continued. First of all, the hardening zone and the carburizing zone are brought to the operating temperature, insofar as this is not as yet the case. As soon as the hardening zone and the carburizing zone are at operating temperature, and the furnace atmosphere is in equilibrium, the conveyor mechanism is activated, and the production can be continued. At the same time, the heating-up zone is switched to operating temperature. It is important that the heating-up zone be the last to arrive at the operating temperature.

The products which have remained in the furnace during shutdown practically do not differ at all, after their completion, from the products finished up during normal operation. The shutdown can be up to 80 hours before any quality impairments are to be expected.

The advance in the art attainable with the process of this invention is remarkable: In case of a plant comprising 40 grates, the 4 grates comprising the hardening zone, as well as, if necessary for safety purposes, the last two grate rows of the heating-up zone, are left without production material prior to shutdown (idle grates). Accordingly, 34 product-occupied grates remain in the plant. The gain in capacity, at a cycle period of 18 minutes, thus is 10.2 hours, corresponding to a capacity gain of 8.5% with a weekly operating period of the plant of 120 hours. Plants having several furnace lanes or longer cycle times correspondingly have an increase of the gain in capacity. Besides the capacity gain, the savings in the energy sector are, of course, also considerable.

EXAMPLE

Gear axle components are hardened in a two-lane plant comprising 24 grates in each lane. Each grate contains approximately 4 to 50 components, depending on size and weight. When the plant is in operation there are 4 grates in each lane in the heating-up zone, 12 grates in each lane in the carburizing zone and 8 grates in each lane in the hardening zone. With cycles lasting 15 minutes each, the components to be hardened therefore spend 60 minutes in the heating-up zone, 180 minutes in the carburizing zone and 120 minutes in the hardening zone. Accordingly, the total time spent by the components in the furnace is 360 minutes. During operation an atmosphere consisting substantially of $N_2$ with 18–30% CO and 20–30% $H_2$ is maintained at a slight pressure of approximately 16 mm $H_2O$ column. The temperature is 950° C., 950° C. and 860° C. in the heating-up zone, the carburizing zone and the hardening zone, respectively. 360 minutes prior to shutdown of the plant 8 empty grates are begun to be added to each lane and these are later located in the hardening zone at shutdown. 30 minutes prior to shutdown 2 empty grates are begun to be added to each lane and remain in the heating-up zone. Simultaneously, the heating in the heating-up zone and the carburizing zone is reduced so as to produce a temperature of approximately 850° C. to 880° C. Once each lane receives the last two empty grates and at the same time the last grate loaded with components has left the hardening zone, the conveyor mechanism is stopped and the temperature in the entire plant is reduced to 700° C. Simultaneously, the carbonaceous atmosphere hitherto present in the plant is replaced by an inert gas atmosphere ($N_2$). The door of the plant (furnace) are locked and the pressure of 16–20 mm $H_2O$ column within the furnace is reduced to 4 mm $H_2O$ column, which results in a reduction in the inert gas consumption. After approximately 64 hours the temperature in all of the zones is brought to 860° C., which takes about two hours. After this temperature is reached, the inert gas atmosphere is replaced by the operating gas atmosphere and the carburizing zone and the hardening zones are heated-up further. Once the carburizing and the hardening zones have reached the operating temperature, which is after approximately 1 hour, the conveyor mechanism is started, the heating-up zone brought to a nominal temperature, which occurs within a short time (10 minutes) owing to the high heating power, and production is continued.

We claim:

1. A process for the temporary shutdown of continuous-discharge carburizing plants wherein a plurality of metallic components to be hardened are conveyed on a conveyor means in succession, through a heating-up zone; a carburizing zone; a pearlitizing zone, if present; and a hardening zone each zone having an operating gas atmosphere characterized by the following steps (a) the hardening zone is cleared of carburized metallic component products;

(b) the conveyor means is stopped, the temperature in the heating-up zone, carburizing, and hardening zones is lowered to 600°–800° C., and simultaneously with lowering of the temperature the operating gas atmosphere is replaced in each zone by an inert gas atmosphere for a temporary period of shutdown;

(c) after termination of the shutdown period, the heating-up, carburizing, and hardening zones are brought to a predetermined temperature of 850°–880° C., and when a zone has reached the predetermined temperature, the inert gas atmosphere is replaced by the operating gas atmosphere; and (d) when all zones have reached the predetermined temperature according to step (c), the hardening zone and the carburizing zone are brought to an operating temperature, whereafter the conveyor means is activated, and the heating-up zone is then brought to an operating temperature.

2. A process according to claim 1, wherein the conveyor means comprises a plurality of conveyor elements connected together each element transporting at least one component to be heated, with the conveyor means advancing through the zone in increments corresponding to the width of one element, the hardening zone is cleared of products by introducing at an appropriate point in time during the operating sequence of the plant, a number of empty conveyor elements which corresponds to the length of the hardening zone so that the hardening zone is charged with these empty conveyor elements during the period of temporary shutdown.

3. A process according to claim 1 or claim 2, wherein the operating pressure within each of the zones in the plant is lowered in step (c) to a pressure on the order of 2 to 6 mm $H_2O$ column.

4. A process according to claim 3, wherein the doors of a furnace defining each of said zones are closed and locked during the period of shutdown and the doors are unlocked and opened during startup.

* * * * *